US008561595B2

(12) United States Patent
Baek et al.

(10) Patent No.: US 8,561,595 B2
(45) Date of Patent: Oct. 22, 2013

(54) DRIVE-INTEGRATED TYPE BLDC FUEL PUMP MODULE

(75) Inventors: Se Dong Baek, Daejeon (KR); Kyoung Hwan Kim, Daejeon (KR); Wan Sung Pae, Daejeon (KR)

(73) Assignee: Coavis, Yeongi-gun (KR)

( * ) Notice: Subject to any disclaimer, the term of this patent is extended or adjusted under 35 U.S.C. 154(b) by 308 days.

(21) Appl. No.: 13/061,671

(22) PCT Filed: Dec. 14, 2010

(86) PCT No.: PCT/KR2010/008955

§ 371 (c)(1), (2), (4) Date: Mar. 1, 2011

(87) PCT Pub. No.: WO2011/074863

PCT Pub. Date: Jun. 23, 2011

(65) Prior Publication Data

US 2012/0000556 A1 Jan. 5, 2012

(30) Foreign Application Priority Data

Dec. 14, 2009 (KR) ..... 10-2009-0123749

(51) Int. Cl.
*F02M 37/08* (2006.01)
*F02M 37/10* (2006.01)

(52) U.S. Cl.
USPC ..... 123/497

(58) Field of Classification Search
USPC ..... 123/497, 509, 514, 480; 417/423.15, 417/423.14, 410.1; 137/565.17; 310/89, 85
See application file for complete search history.

(56) References Cited

U.S. PATENT DOCUMENTS

2007/0025866 A1* 2/2007 Douyama et al. ..... 417/423.3
2009/0031995 A1 2/2009 Tateishi

FOREIGN PATENT DOCUMENTS

| | | | |
|---|---|---|---|
| JP | 2001214826 | A | 8/2001 |
| JP | 2004332582 | A | 11/2004 |
| JP | 2006329079 | A | 12/2006 |
| JP | 2009036101 | A | 2/2009 |
| JP | 2009228466 | A | 10/2009 |
| KR | 1020090100865 | A | 9/2009 |

* cited by examiner

*Primary Examiner* — Mahmoud Gimie
(74) *Attorney, Agent, or Firm* — The Webb Law Firm

(57) ABSTRACT

Provided is a driver-integrated type BLDC fuel pump module, which is used in a vehicle and in which a driver used for controlling the operation of a BLDC fuel pump is installed in a flange of the BLDC fuel pump module, thus removing the spatial limit caused when the driver is installed and reducing the length of an electric wire electrically connecting the driver to a BLDC fuel pump of the module, thereby solving the problem of the operational performance of the BLDC fuel pump deteriorating as a result of both the voltage drop in the electric wire and a reduction in the operational efficiency of the pump.

3 Claims, 6 Drawing Sheets

DRIVE-INTEGRATED TYPE BLDC FUEL PUMP MODULE

BACKGROUND OF THE INVENTION

1. Field of the Invention

The present invention relates, in general, to driver-integrated type Brushless D/C Motor (BLDC) fuel pump modules used in vehicles and, more particularly, to a driver-integrated type BLDC fuel pump module, in which a driver used for controlling operation of a BLDC fuel pump is installed in a flange of the BLDC fuel pump module, thus removing the spatial limit caused when installing the driver and reducing the length of an electric wire electrically connecting the driver to a BLDC fuel pump of the module, thereby solving the problem of deterioration in operational performance of the BLDC fuel pump caused both by the voltage drop in the electric wire and by the reduction in operational efficiency of the pump.

2. Description of the Related Art

Generally, FIG. 1 is an exploded perspective view illustrating a conventional driver 10, a conventional BLDC fuel pump module 20 and a connector 30 for electrically connecting the driver 10 to the BLDC fuel pump module 20.

To drive a BLDC pump using a BLDC motor, a driver 10, which functions as a controller, is required to control the sequence in which an electric current of respective phases (U-phase, V-phase, W-phase) is supplied and to control the rpm of the motor.

In the BLDC fuel pump module 20, a flange 21 is mounted to a fuel tank (not shown) in such a way that the upper surface of the flange 21 is exposed to outside the fuel tank and remaining elements of the BLDC fuel pump module 20 are installed in the fuel tank.

In the related art, the driver 10 and the BLDC fuel pump module 20, which are used for feeding fuel to an internal combustion engine under the desired pressure and at a desired flow rate, are separated from each other, so that, when the driver 10 and the BLDC fuel pump module 20 are installed in a vehicle, there occurs a limit in both the locations of the driver 10 and the BLDC fuel pump module 20 inside the vehicle and the distance between the driver 10 and the BLDC fuel pump module 20 due to the limited length of an electric wire 30 used for supplying electricity between the driver 10 and the BLDC fuel pump module 20, and there occurs a reduction in the operational efficiency of both the driver 10 and the BLDC fuel pump module 20 because of the voltage drop in the electric wire 30.

SUMMARY OF THE INVENTION

Accordingly, the present invention has been made keeping in mind the above problems occurring in the related art, and the present invention is intended to propose a driver-integrated type BLDC fuel pump module, in which a driver is directly installed in a flange of the module, thus removing the spatial limit that takes place when installing the driver and reducing the length of an electric wire electrically connecting the driver to a BLDC fuel pump of the module, thereby solving the problem of the operational performance of the BLDC fuel pump deteriorating which is caused both by the voltage drop in the electric wire and the reduction in the operational efficiency of the pump.

In order to achieve the above object, according to one aspect of the present invention, there is provided a driver-integrated type BLDC fuel pump module, comprising: a flange mounted to a fuel tank in such a way that an upper surface of the flange is exposed to outside the fuel tank; a guide rod connected to a lower surface of the flange and extending downwards; and a reservoir body assembly connected to a lower end of the guide rods and receiving a BLDC fuel pump therein, further comprising: a driver for controlling an operation of the BLDC fuel pump, the driver being mounted to the upper surface of the flange; a first driver connector provided on the upper surface of the flange for supplying electricity to the driver; and a second driver connector provided on the lower surface of the flange for electrically connecting the driver to the BLDC fuel pump.

In the driver-integrated type BLDC fuel pump module, the flange may be provided with a driver receiving frame on the upper surface thereof, the driver receiving frame being vertically formed on the upper surface of the flange in such a way that the driver receiving frame forms a closed curved wall and receives the driver therein; and the first driver connector may protrude outwards from an outer surface of the driver receiving frame.

Further, the driver receiving frame may be capped on an upper end thereof with a driver protective cap for protecting the driver.

Further, the driver protective cap may be provided in a lower surface thereof with an elastic member for sealing a junction between the upper end of the driver receiving frame and the lower surface of the driver protective cap.

Further, the driver protective cap may be made of aluminum or stainless steel, so that the driver protective cap can effectively dissipate heat generated by electric devices mounted in the driver to surroundings.

As described above, the driver-integrated type BLDC fuel pump module according to the present invention is advantageous in that the driver is installed in the flange, so that, when installing the driver-integrated type BLDC fuel pump module in a vehicle, the present invention can solve the problem of a spatial limit being imposed by the driver.

Further, the driver-integrated type BLDC fuel pump module according to the present invention is advantageous in that, because the driver is installed in the flange, the length of the electric wire electrically connecting the driver to the BLDC fuel pump can be reduced, thereby solving the problem of the operational performance of the BLDC fuel pump deteriorating as a result of the voltage drop in the electric wire and the reduction in operational efficiency of the pump.

Further, the driver-integrated type BLDC fuel pump module according to the present invention is advantageous in that, because the driver is installed in the flange, it is not necessary to separately injection-mold a connector for connecting the BLDC fuel pump module to the driver or to a driver casing, thereby simplifying the production and assembly processes of the BLDC fuel pump module.

Further, the driver-integrated type BLDC fuel pump module according to the present invention is advantageous in that the driver protective cap is made of aluminum or stainless steel, so that the driver protective cap has improved heat dissipating performance, thereby effectively dissipating to the atmosphere the heat generated by electric devices mounted in the driver.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, a preferred embodiment of a driver-integrated type BLDC fuel pump module according to the present invention will be described in detail with reference to the accompanying drawings.

Figure 1:
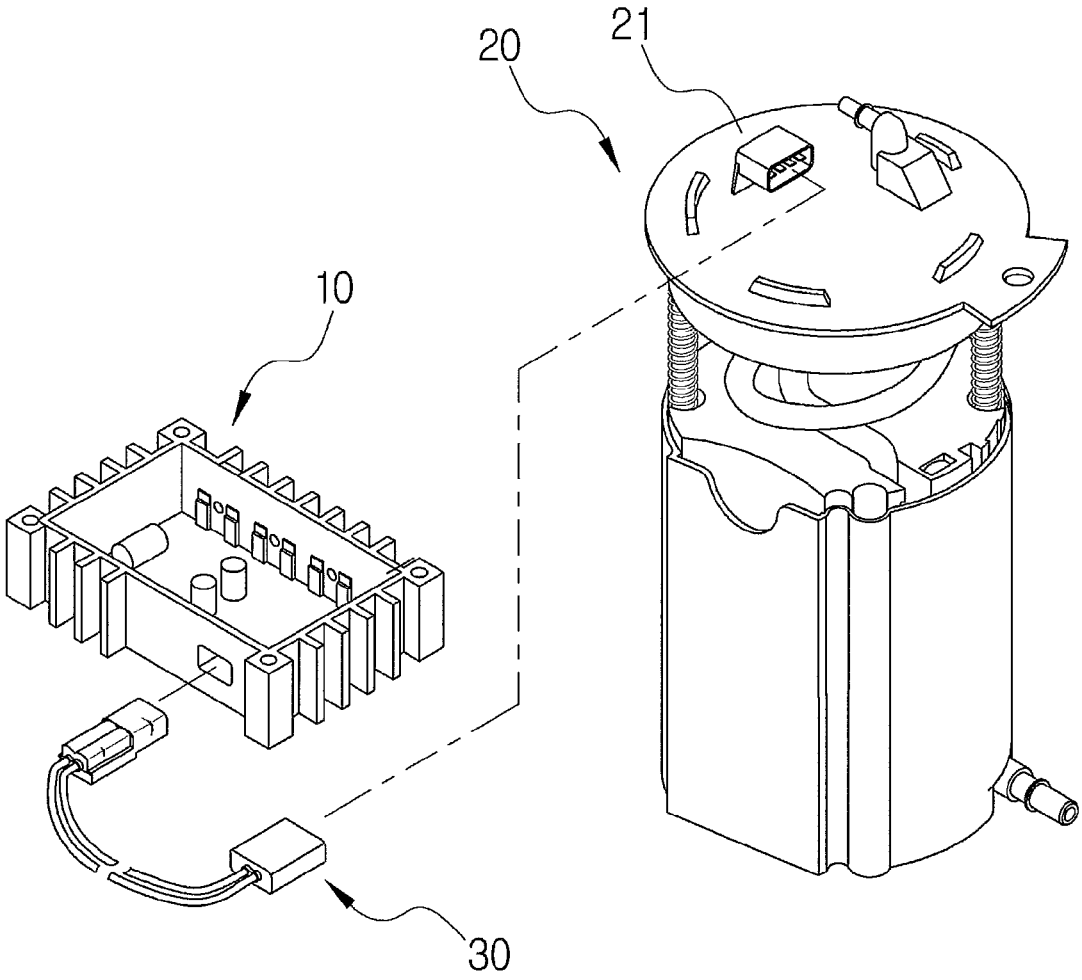
FIG. 1 is an exploded perspective view illustrating a conventional driver, a conventional BLDC fuel pump module and a connector for electrically connecting the driver to the BLDC fuel pump module.
Figure 2:
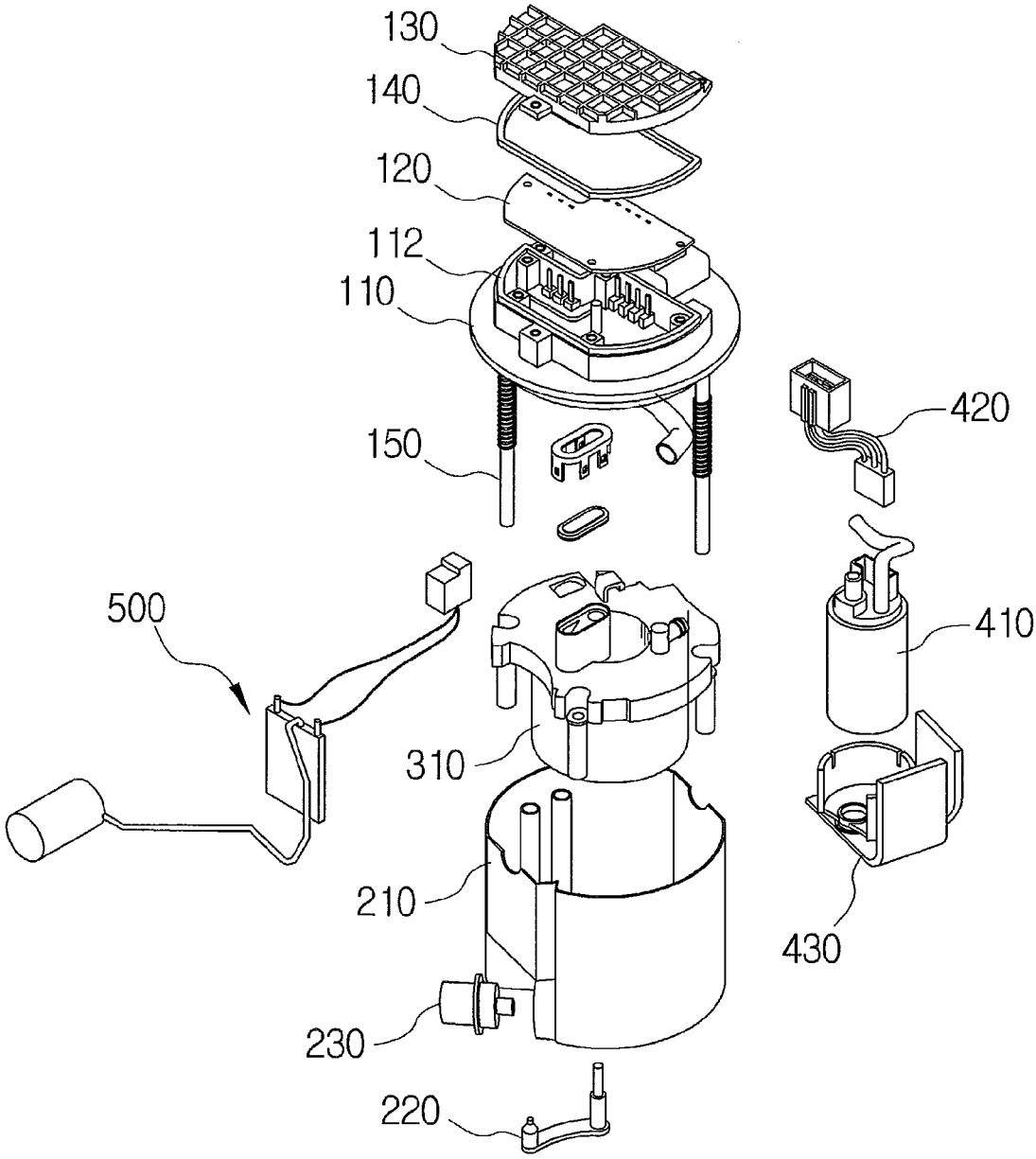
FIG. 2 is an exploded perspective view illustrating a driver-integrated type BLDC fuel pump module according to an embodiment of the present invention.
Figure 3:
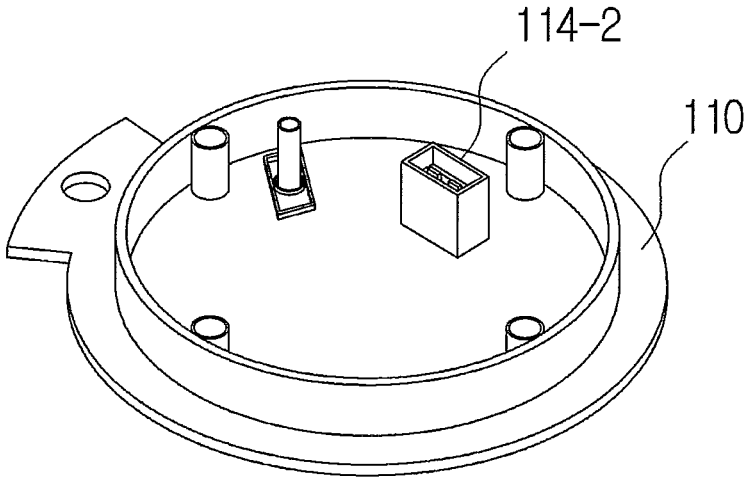
FIG. 3 is a rear perspective view illustrating a flange of the driver-integrated type BLDC fuel pump module according to the embodiment of the present invention.

FIG. 2 is an exploded perspective view illustrating a driver-integrated type BLDC fuel pump module according to an embodiment of the present invention. FIG. 3 is a rear perspective view illustrating a flange of the driver-integrated type BLDC fuel pump module according to the embodiment of the present invention. FIGS. 4 through 8 are views illustrating a process of assembling the driver-integrated type BLDC fuel pump module according to the embodiment of the present invention.

As shown in FIG. 2, the driver-integrated type BLDC fuel pump module according to the embodiment of the present invention includes a flange 110, a reservoir 210, an in-tank filter 310 and a BLDC fuel pump 410.

Referring to FIGS. 2, 3 and 4 through 8, a driver receiving frame 112 is provided on the upper surface of the flange 110. The driver receiving frame 112 is vertically formed on the upper surface of the flange 110 in such a way that the frame 112 forms a closed curved wall. The top of the driver receiving frame 112 is open, thereby defining therein a driver receiving chamber (not designated) for receiving the driver 120. Although it is not shown in the accompanying drawings, the flange 110 is mounted to a fuel tank (not shown) in such a way that the upper surface of the flange 110 is exposed to outside the fuel tank, while the lower surface of the flange 110 is placed inside the fuel tank.

As shown in FIGS. 2 and 4 through FIG. 8, the driver 120 is received in the driver receiving chamber. The driver 120 is a controller for controlling the operation of a BLDC fuel pump 410. The driver 120 may use a PCB, on which electric devices for controlling the operation of the BLDC fuel pump 410 are mounted.

Referring to FIG. 4 through FIG. 8, the upper surface of the flange 110 is provided with a first driver connector 114-1 for supplying electricity to the driver 120. The first driver connector 114-1 protrudes outwards from the outer surface of the driver receiving frame 112.

As shown in FIG. 3, a second driver connector 114-2 for electrically connecting the driver 120 to the BLDC fuel pump 410 protrudes from the lower surface of the flange 410. As shown in FIG. 2, the driver 120 is electrically connected at a first end thereof to the second driver connector 114-2, while a second end of the driver 120 is electrically connected to the BLDC fuel pump 410 by a connector module 420 connected to the BLDC fuel pump 410.

Figure 4:
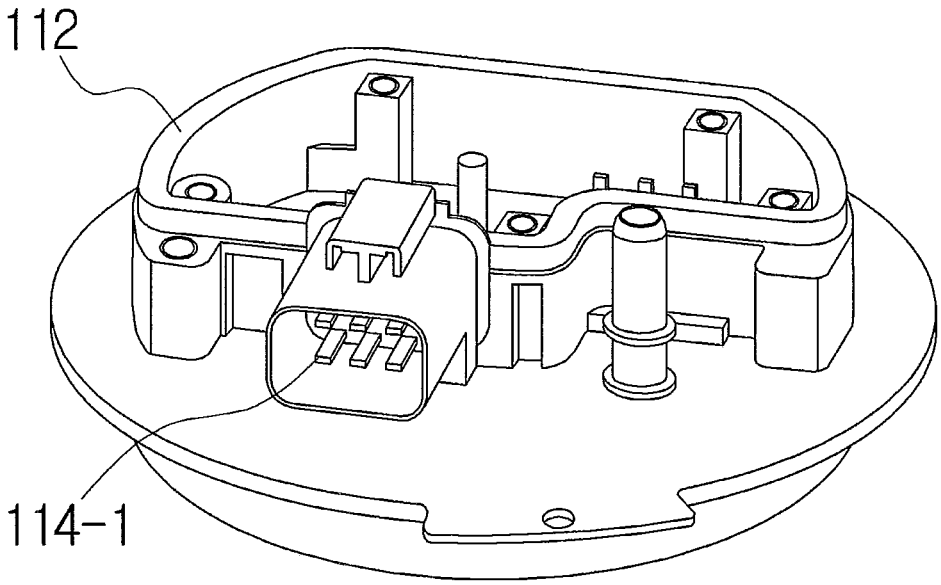
FIGS. 4 through 8 are views illustrating a process of assembling the driver-integrated type BLDC fuel pump module according to the embodiment of the present invention.
Figure 5:
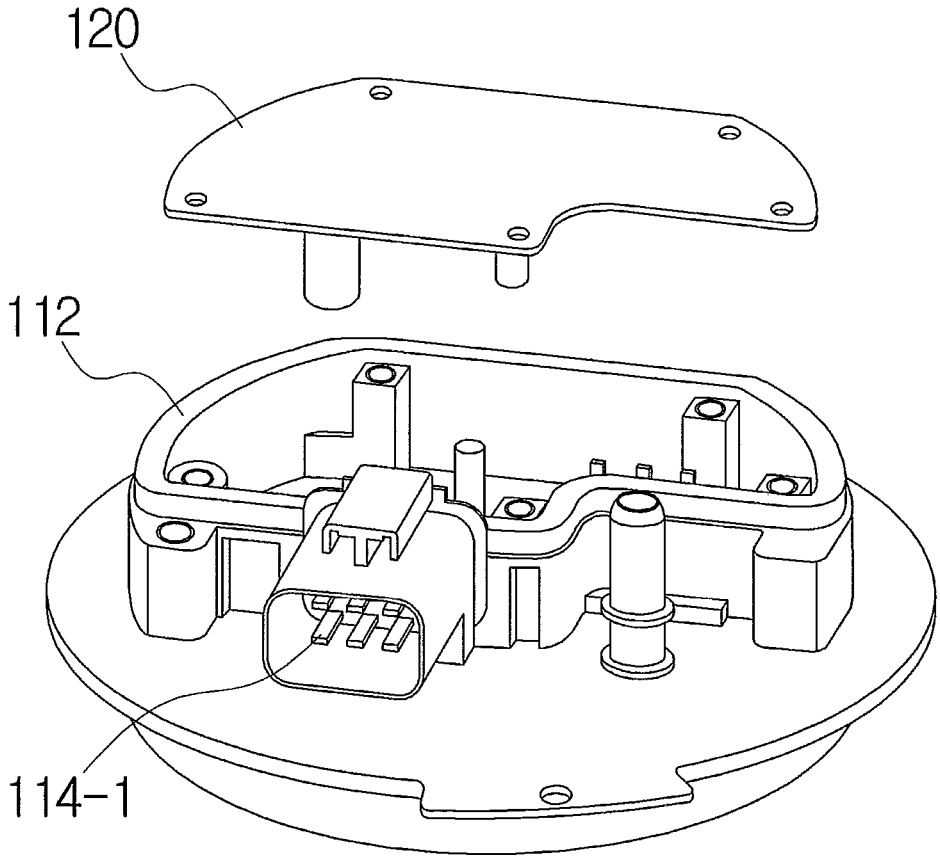
Figure 6:
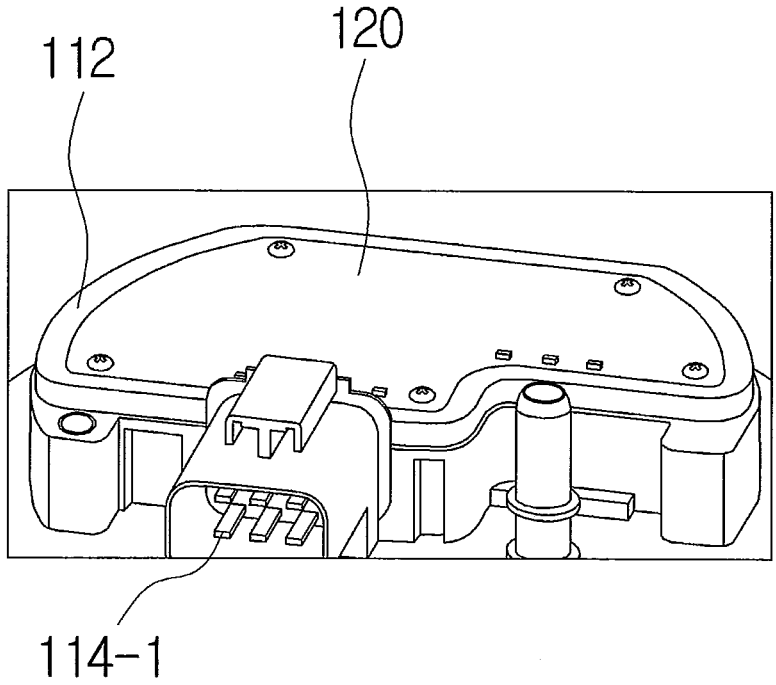
Figure 7:
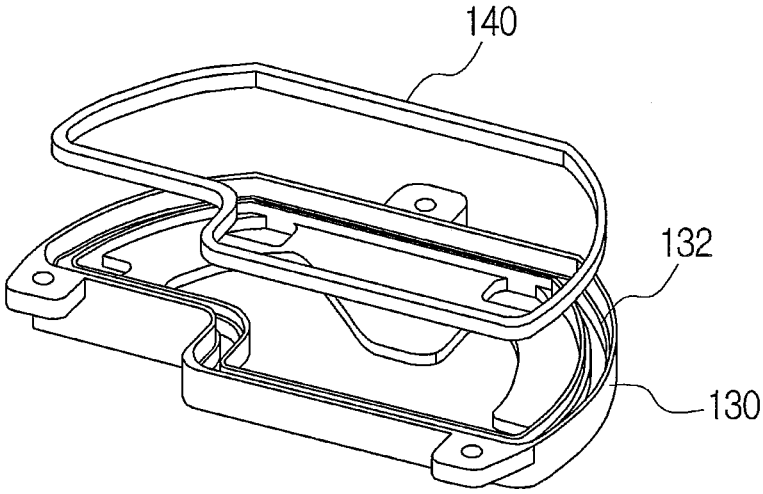
Figure 8:
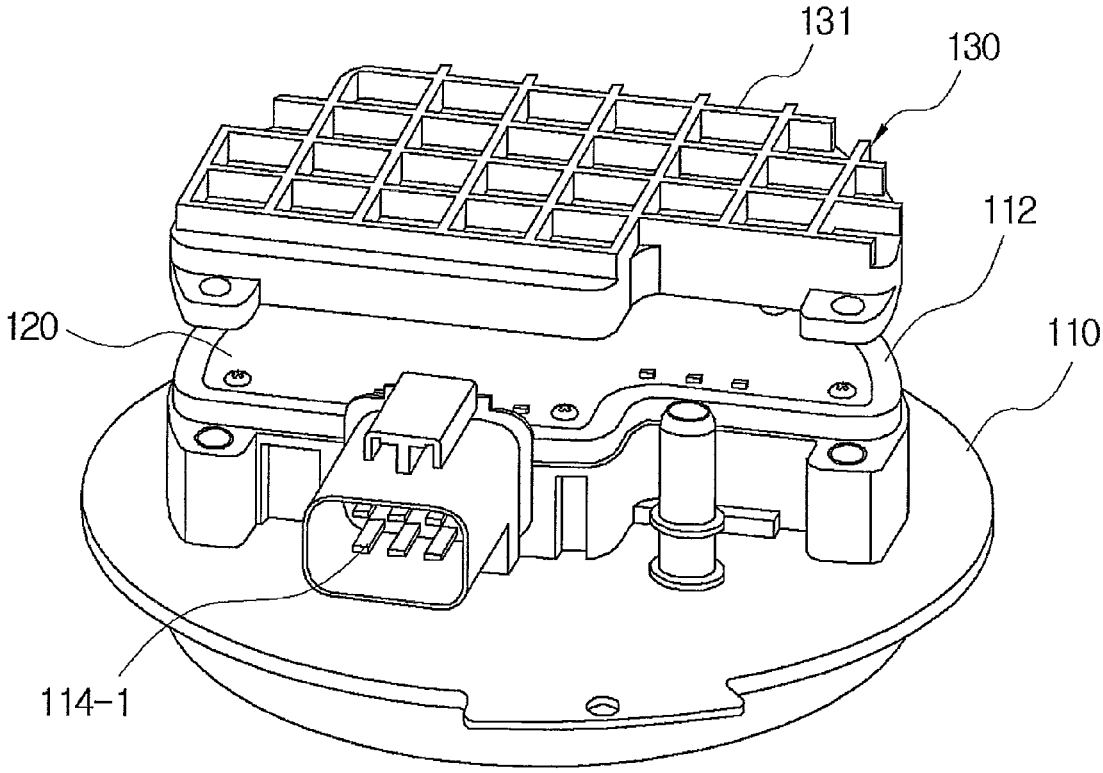

Referring to FIGS. 2 and 4 though 8, a driver protective cap 130 is mounted to the open top of the driver receiving frame 112. The driver protective cap 130 seals and protects the driver 120. To realize high heat dissipating performance of the driver protective cap 130, the driver protective cap 130, which includes a heat dissipation part 131, is made of a material having a high thermal conduction rate. In the present invention, it is preferred that the driver protective cap 130 be made of aluminum or stainless steel. Because the driver protective cap 130 is made of aluminum or stainless steel, the heat dissipating performance of the driver protective cap 130 is increased, and the driver protective cap 130 can effectively dissipate heat generated from electric devices, such as FET and MCU, mounted on the driver 120 to the atmosphere.

As shown in FIGS. 2 and 4 through FIG. 8, an elastic member 140 is provided in the lower surface of the driver protective cap 130 for sealing the junction between the upper end of the driver receiving frame 112 and the lower surface of the driver protective cap 130. To securely seat the elastic member 140 in the driver protective cap 130, the lower surface of the driver protective cap 130 may be provided with an elastic member seat groove 132. The elastic member 140 may be made of rubber.

As shown in FIG. 2, the in-tank filter 310 is installed in the reservoir 210, and the BLDC fuel pump 410 is installed in a pump receiving chamber (not designated) formed in the central portion of the in-tank filter 310. The BLDC fuel pump 410 is a BLDC pump drive by a BLDC driver.

As shown in FIG. 2, a check valve 220 is provided in the lower surface of the reservoir 210. Further, a regulator 230 is mounted to the reservoir 210 from the outside in such a way that the distal end of the regulator 230 is placed inside the reservoir 210. The distal end of the regulator 230 is connected to the in-tank filter 310, so that the regulator 230 can return part of the fuel, supplied from the in-tank filter 310 to an internal combustion engine, to the reservoir 210. Further, the distal end of the regulator 230 may be connected to the fuel tank (not shown) by a connection hose (not shown), so that, when part of the fuel, supplied from the in-tank filter 310 to the internal combustion engine, is returned to the reservoir 210 by the regulator 230, the fuel stored in the fuel tank can be introduced into the reservoir 210 according to the orifice effect.

As shown in FIG. 2, a primary filter 430 is mounted to the lower end of the BLDC fuel pump 410. The primary filter 430 filters the fuel inside the reservoir 210 before the fuel flows into the BLDC fuel pump 410. After passing through the primary filter 430, the fuel is sucked by the BLDC fuel pump 410 and is secondarily filtered by the in-tank filter 310 and is, thereafter, supplied to the internal combustion engine.

In the drawings, the reference numeral 500 denotes a fuel gauge module, which is connected to the reservoir 210 and is installed in the fuel tank.

As shown in FIG. 2, the upper ends of guide rods 150 are mounted to the lower surface of the flange 110. The lower ends of the guide rods 150 are connected to the in-tank filter 310. In other words, a reservoir body assembly (not designated), which includes the reservoir 210, the in-tank filter 310, the BLDC fuel pump 410, etc., is mounted to the flange 110 by the guide rods 150 and is securely installed in the fuel tank.

Hereinbelow, the operation of the above-mentioned driver-integrated type BLDC fuel pump module according to the embodiment of the present invention will be described.

As described above, in the driver-integrated type BLDC fuel pump module according to the embodiment of the present invention, the driver 130 is mounted in the flange 110, so that, when the driver-integrated type BLDC fuel pump module is installed in a vehicle, there is no spatial limit caused by the installation of the driver 130.

Further, because the driver 130 is mounted in the flange 110 of the driver-integrated type BLDC fuel pump module according to the embodiment of the present invention, the length of the electric wire electrically connecting the driver 130 to the BLDC fuel pump 410 can be reduced, thereby solving the problem of the operational performance of the BLDC fuel pump 410 deteriorating as a result of both the voltage drop in the electric wire and the reduction in operational efficiency of the pump 410.

Further, because the driver 130 is mounted in the flange 110 of the driver-integrated type BLDC fuel pump module according to the embodiment of the present invention, it is not necessary to separately injection-mold a connector for connecting the BLDC fuel pump module to the driver or to a driver casing, thereby simplifying the production and assembly processes of the BLDC fuel pump module.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A driver-integrated type BLDC fuel pump module, comprising: a flange mounted to a fuel tank in such a way that an upper surface of the flange is exposed to outside the fuel tank; a guide rod connected to a lower surface of the flange and extending downwards; and a reservoir body assembly connected to a lower end of the guide rods and receiving a BLDC fuel pump therein, further comprising:

a driver for controlling an operation of the BLDC fuel pump, the driver being mounted to the upper surface of the flange;

a first driver connector provided on the upper surface of the flange for supplying electricity to the driver;

a second driver connector provided on the lower surface of the flange for electrically connecting the driver to the BLDC fuel pump;

a driver receiving frame vertically formed on the upper surface of the flange in such a way that the driver receiving frame forms a closed curved wall and receives the driver therein; and a driver protective cap formed on an upper end of the driver receiving frame in order to protect the driver, wherein a heat dissipation part protrudes from an upper surface of the driver protective cap.

2. The driver-integrated type BLDC fuel pump module as set forth in claim 1, wherein the driver protective cap is provided in a lower surface thereof with an elastic member for sealing a junction between the upper end of the driver receiving frame and the lower surface of the driver protective cap.

3. The driver-integrated type BLDC fuel pump module as set forth in claim 2, wherein the driver protective cap is made of aluminum or stainless steel, so that the driver protective cap can effectively dissipate heat generated by electric devices mounted in the driver to surroundings.

* * * * *